US005427025A

United States Patent [19]

Lee et al.

[11] Patent Number: 5,427,025

[45] Date of Patent: Jun. 27, 1995

[54] COMPLIANT PLATEN FOR HIGH SPEED FLAT BED PRINTER

[75] Inventors: Henry Lee, Worthington, Ohio; James A. Salomon, Cheshire, Conn.; Daniel B. Young; Jerome E. Jackson, both of Newtown, Conn.

[73] Assignee: Pitney Bowes Inc., Stamford, Conn.

[21] Appl. No.: 323,405

[22] Filed: Oct. 14, 1994

[51] Int. Cl.[6] ..... B41F 13/10

[52] U.S. Cl. ..... 101/371; 101/378; 400/56

[58] Field of Search ..... 101/371, 378, 387, 368, 101/93, 327, 333; 400/55, 56

[56] References Cited

U.S. PATENT DOCUMENTS

| | | | |
|---|---|---|---|
| 2,002,895 | 5/1935 | Kakanour | 101/368 |
| 2,068,649 | 1/1937 | Anderson | 101/368 |
| 2,902,925 | 9/1959 | Wagner | 101/368 |
| 4,227,819 | 10/1980 | Manriquez | 400/56 |
| 4,422,782 | 12/1983 | Lawter | 400/56 |
| 4,929,106 | 5/1990 | Buan et al. | 400/649 |
| 4,949,098 | 8/1990 | Gluck et al. | 400/56 |
| 5,020,429 | 6/1991 | Riley et al. | 101/93 |
| 5,060,741 | 10/1991 | Abellana et al. | 177/4 |
| 5,168,804 | 12/1992 | Lee et al. | 101/93 |
| 5,172,631 | 12/1992 | Manna | 101/371 |
| 5,269,220 | 12/1993 | Doery et al. | 101/91 |

*Primary Examiner*—Eugene H. Eickholt

*Attorney, Agent, or Firm*—Steven J. Shapiro; Melvin J. Scolnick; David E. Pitchenik

[57] ABSTRACT

A flat bed printing mechanism for a postage meter is disclosed which includes a flat printing die, a platen mounted beneath the printing which is movable toward and away from the printing die to as to bring the image area of a mail piece disposed over the platen into printing contact with the printing die. The platen supports a resilient pressure pad which contacts the mail piece, and there is a resilient means interposed between the upper surface of the platen and the lower surface of the pressure pad to support the pressure pad in spaced relationship with the upper surface of the platen so that the pressure pad is free to move both linearly and angularly with respect to the platen when the platen moves upwardly to press the mail piece against the printing die, to cause the plane of the upper surface of the pressure pad to conform to the plane of the image area of the mail piece as the platen pushes the image area of the mail piece upwardly toward the printing die.

9 Claims, 7 Drawing Sheets

COMPLIANT PLATEN FOR HIGH SPEED FLAT BED PRINTER

BACKGROUND OF THE INVENTION

This invention relates generally to the field of postage meters for mailing machines, and more particularly to an improved printing mechanism for pressing a mail piece against a postage indicia printing die in a high speed flat bed type printer.

Automated mail processing apparatus is well known and widely used in large volume mailing applications where a high throughput speed is essential. Some examples of large volume mailing in the context of the aforementioned apparatus are credit card companies, banks, chain department stores, book clubs, etc., where each month some form of mailing, such as bills, solicitations, advertisements, etc., are sent to tens if not hundreds of thousands of card holders, customers, subscribers, etc., as the case may be. Were it not for the type of mail processing apparatus with which the present invention is concerned, such mass mailings could not be carried out.

This type of mail processing apparatus generally comprises a plurality of mail processing components disposed adjacent one another and defining a feed path along which individual mail pieces are fed seriatim from one component to another. In a typical installation, mail, which has already been assembled by suitable collating and envelope inserting equipment, is either fed directly to the mail processing apparatus, or may be manually stacked in the hopper of a separator/feeder component of the mail processing apparatus which feeds the mail pieces into an envelope flap sealer component where the flaps are moistened, folded over and sealed. The mail pieces are then fed onto the platform of a weighing component which weighs each piece, either to ensure that it's weight is within preset limits for the application of a preset amount of postage, or to change the postage amount printing wheels of a postage meter component to cause it to print a different amount of postage. The mail pieces are then either in position to have postage printed thereon, or are fed to such position, depending upon the size of the mail pieces, after which an appropriate amount of postage is printed on the mail pieces.

In mail processing apparatus of the apparent degree of sophistication, complexity and cost as that just described, it is essential that such equipment operate at a high rate of speed in order to achieve maximum efficiency and make the apparatus cost effective. Much of the mail processing apparatus now in commercial use has achieved this objective and operates relatively successfully. Certain problems do exist, however, some more serious than others, and continuing design and development is carried on generally to constantly improve the performance of the apparatus and particularly to find solutions to problems which have become known.

One problem in particular that is of major significance in mail processing apparatus is the print quality of the postage indicia printed on the mail pieces by the printing mechanism of the postage meter. In order for postage meters to be accepted for commercial use by the United States Postal Service, the printing mechanism of the meters must be able to print postage indicia which meets certain standards of print quality established by the USPS. Since the postage indicia contains certain vital information, such as the location from which mail is dispatched, the date thereof and the amount of postage paid by the sender, it is necessary that the indicia be printed with sufficient clarity that this information can be readily read when necessary. Postage indicia which is not readable is unacceptable to the USPS, and postage meter equipment which prints such indicia will not be approved for commercial use.

A major factor which contributes to poor postage indicia print quality is the speed of operation of the postage meter printing the indicia. A postage meter that prints a perfectly acceptable indicia at one speed may not print an acceptable indicia when operated at a considerably higher speed. This is particularly so in the case of a postage meter printing device having a flat bed printer, i.e., a printer having a fixed flat postage indicia printing die against which a mail piece is pressed by a movable platen. The dynamic forces involved in bringing the ink receiving surface of mail pieces into intimate contact with the inked surface of the printing die are much more complicated in the case of the flat bed printer than they are with a curved printing die in a rotary printer where printing of the indicia takes place while the mail pieces are in motion.

In existing automated mail processing apparatus as previously described, the weighing component comprises a scale having a platform which forms a segment of the feed path along which mail pieces are fed. A transport mechanism, comprising generally a plurality of transport rollers, or an endless transport belt, in cooperation with opposed pressure skis which include rollers which press the mail piece into firm engagement with the transport rollers or belt, moves each mail piece onto the platform and stops the movement when the mail piece is in a desired position for weighing. The postage meter is generally situated behind the platform of the weighing scale in a position such that, depending on the size of the mail piece, it will be in position for printing of the postage indicia by the postage meter when it is in the weighing position. This is true at least for most standard and large size mail pieces; short mail pieces may have to be further advanced along the scale platform to bring them to a desired printing position. After a mail piece is weighed, a rigid platen having a resilient pressure pad affixed to the upper surface thereof rises from below the level of the upper surface of the scale platform and pushes upwardly on the upper right hand corner of the mail piece to bring it into intimate contact with the underside of the printing die, which is inked just prior to each printing operation by a suitable inking device that is part of the printing mechanism of the postage meter. During the time that the corner of the mail piece is being moved upwardly by the platen, the rest of the mail piece remains captured between the transport rollers or belt and the pressure skis to prevent inadvertent movement of the mail piece.

The dynamic problem that occurs during this operation of the printing mechanism at a high rate of speed is that when the platen rises, the upper surface of the pressure pad makes initial contact with the undersurface of the mail piece adjacent a corner of the mail piece where the postage indicia is to be printed, and allows it to tilt with respect to the top of the pressure pad. As the image area portion of the mail piece tilts, the plane of at least this portion of the mail piece, and perhaps its entirety, is disposed at an angle to the plane of the upper surface of the pressure pad and also the lower surface of the printing die, these two surfaces being parallel to one another. As the platen continues to rise, the lower surface of the image area portion of the mail piece is clamped by the skis against the pressure pad so that only the forward upper edge of the pressure pad contacts the lower surface of the mail piece, with the result that a pivot line is established in the mail piece adjacent the outboard edge of the pressure pad. As the pressure pad pushes further upwardly on the now angled portion of the mail piece, it lifts the skis and raises the image area portion of the mail piece to contact the printing die at the angle described. However, during this further upward movement, the rear edge of the mail piece makes initial contact with the printing die adjacent the rear edge thereof, thereby establishing an initial contact at the rear edge of the mail piece and producing an image of a rear portion of the printing die. Since the image area portion of the mail piece is rigidly held between the upper forward edge of the pressure pad and the ski or skis being pushed upwardly thereby, and since the pivot line can only rise vertically, the upward movement of the pressure pad, which is causing the image area portion to gradually become parallel to the under surface of the printing die, causes the rear edge of the mail piece to shift laterally a slight amount with respect to the surface of the printing die, with the result that the entire image area portion of the mail piece is displaced slightly with respect to the surface of the printing die while it is being pressed into intimate contact with the surface of the printing die. This relative movement, slight as it may be, between the image area portion of the mail piece and the surface of the printing die, is sufficient to cause ink to smudge or smear and result in a printed indicia which lacks the quality of clarity required by the USPS standards for acceptable postage indicia printing.

BRIEF SUMMARY OF THE INVENTION

The foregoing problem is substantially alleviated, if not altogether eliminated, by the present invention, in which a flexible supporting member is interposed between the lower surface of the resilient pressure pad and the upper surface of the rigid platen, which permits the resilient pad to move both linearly and angularly with respect to the upper surface of the platen. The flexible supporting member is secured both to the upper surface of the platen and the lower surface of the pressure pad, and in the normal unstressed condition of the supporting member these surfaces are disposed about 0.140 inch apart and are parallel to each other. The supporting member allows the pressure pad to move both toward the upper surface of the platen within the 0.140 inch separation, and also to tilt or move angularly about a longitudinal axis which permits the pressure pad to assume the same angle as the image area portion of the mail piece, so that the upper surface of the pressure pad makes full surface contact with the lower surface of the image area portion of the mail piece during upward movement of the platen. With this construction, the aforementioned pivot line adjacent the forward edge of the pressure pad is completely eliminated, and a pivot line adjacent the rear edge of the image area portion of the mail piece and the corresponding edge of the die is created, with the result that the image area portion does not move laterally with respect to the printing surface of the die during the remaining portion of upward movement of the platen.

With the foregoing in mind, the present invention, in its broader aspects, comprises, in a flat bed postage indicia printing mechanism for a postage meter, a flat printing die fixedly mounted in the postage meter printing mechanism, a platen mounted beneath the printing die and having an upper surface normally disposed in spaced parallel relationship with the printing surface of the printing die, and a pressure pad positioned on the upper surface of the platen for contacting the lower surface of a mail piece. There is means for moving the platen toward and away from the printing die so as to bring a portion of the upper surface of a mail piece resting on the platen into contact with the printing surface of the printing die. And there is means disposed between the supper surface of the platen and the pressure pad for supporting the pressure pad on the platen for limited linear and angular movement with respect to the upper surface of the platen. With this arrangement, as the platen moves upwardly, the pressure pad moves linearly with respect to the upper surface of the platen to absorb the shock of high speed impact with the image area portion of the mail piece and angularly with respect to the upper surface of the platen so that the plane of the upper surface of the pressure pad conforms to the plane of the mail piece as the platen pushes the mail piece upwardly toward the printing die.

In some of its more limited aspects, the pressure pad supporting means comprises flexible means for normally supporting the pressure pad with the lower surface thereof disposed in spaced parallel relationship with the upper surface of the platen, the flexible means generally being a flat supporting member for holding the pressure pad on the upper surface thereof and having resilient means for securing it to the upper surface of the platen. The flexible means is preferably a substantially flat body member having a planar configuration corresponding to that of the upper surface of the platen with the pressure pad being suitably secured to the upper surface thereof, such as by bonding.

In the presently preferred embodiment of the invention, the supporting member has a plurality of generally U-shaped flexible arms which are connected at one end to the flat body member which supports the pressure pad and are connected at the other end to the upper surface of the platen so that the body member is free to move in the linear and angular directions as aforesaid. The flexible arms extend from the plane of the body member away therefrom in one direction to a second plane spaced from the plane of the body member, and then in a reverse direction to a third plane spaced from the second plane, the terminal portions of the flexible arms which lie in the third plane being connected to the surface of the platen, so that the lower surface of the pressure pad is then supported in spaced relationship with the upper surface of the platen and can move both linearly and angularly with respect thereto.

Having briefly described the general nature of the present invention, it is a principal object thereof to provide an improved flat bed postage indicia printing mechanism which prints a clear and sharp image of a postage indicia on the image area portion of a mail piece.

It is another object of the present invention to provide an improved flat bed postage printing mechanism which prints a clear and sharp image of a postage indicia on the image area portion of a mail piece without loss of the speed and efficiency of current postage indicia printing mechanisms and with a minimum of added complexity and cost.

It is still another object of the present invention to provide a flat bed postage indicia printing mechanism in which the pressure pad which presses a mail piece against a flat printing die can move relative to the upper surface of a platen to accommodate the angle of a mail piece that is being moved into contact with a printing die so as to eliminate relative movement between the mail piece and the printing die during the printing operation.

It is still another object of the present invention to provide a flat bed postage indicia printing mechanism which is extremely simple in constriction, inexpensive to manufacture and requires virtually no maintenance.

These and other objects and advantages of the present invention will be more apparent from an understanding of the following detailed description of a presently preferred embodiment of the invention, when considered in conjunction with the accompanying drawings.

DETAILED DESCRIPTION OF THE INVENTION

Figure 1:
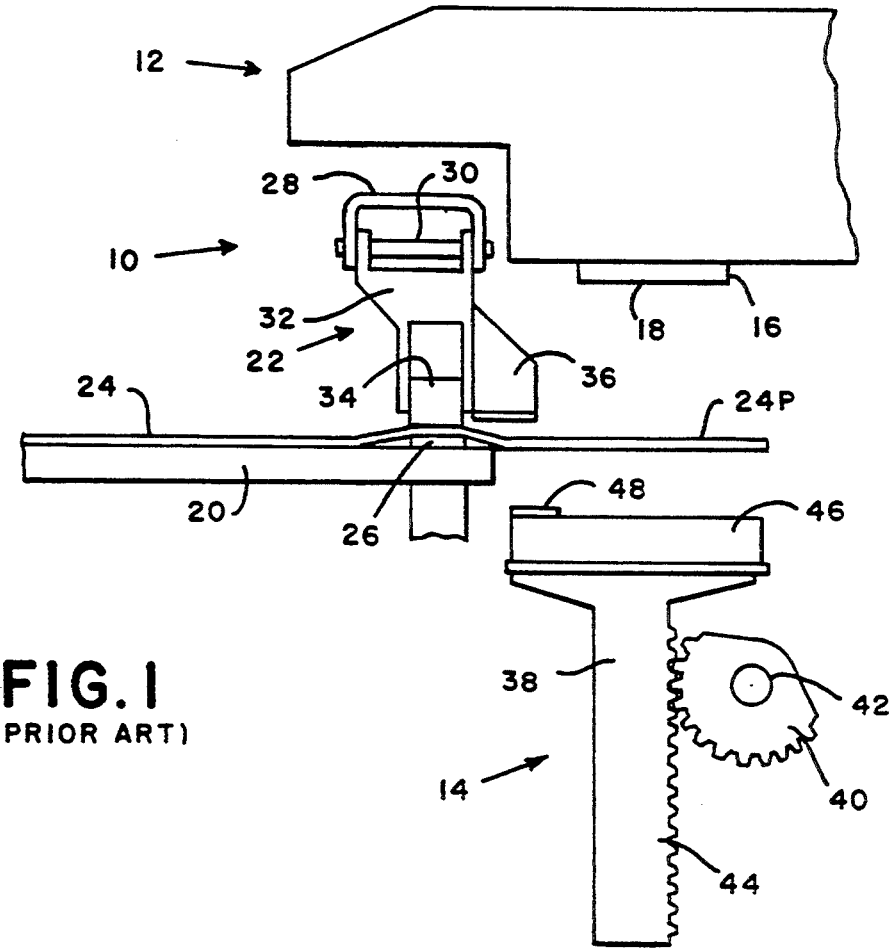
FIG. 1 (PRIOR ART)
FIG. 1 is a side elevation of only so much of a prior art mailing machine as is necessary to illustrate the problem that is solved by the present invention, including a mail transport platform, a vertically movable platen and a postage indicia printing die.
Figure 2:
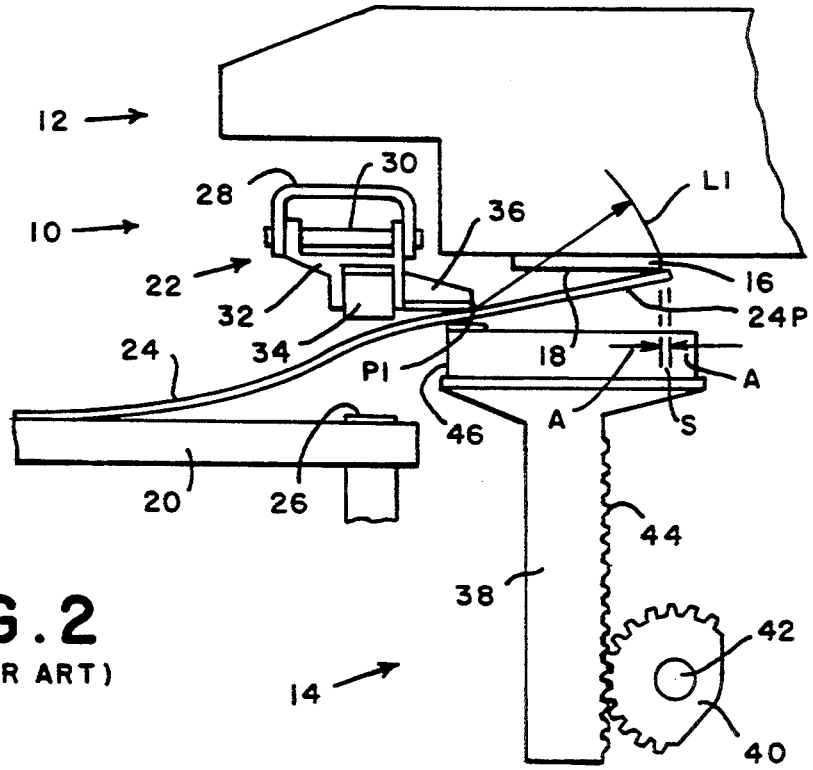
FIG. 2 (PRIOR ART)
FIG. 2 is a view similar to FIG. 1, but showing the platen in a partially elevated position with the image area portion of a mail piece being pushed toward the printing surface of the die.
Figure 3:
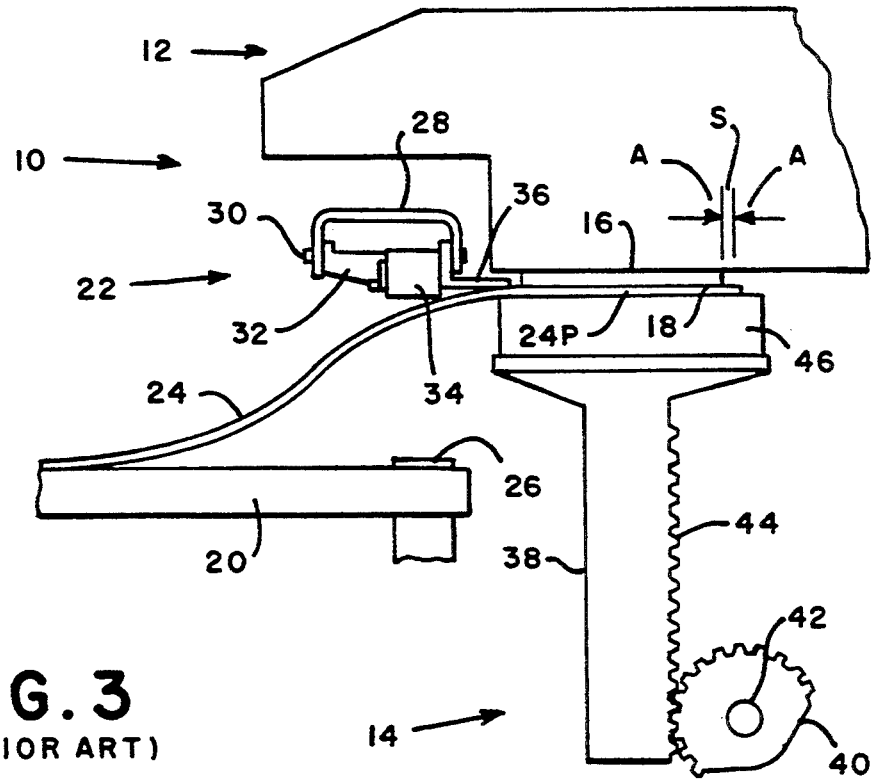
FIG. 3 (PRIOR ART)
FIG. 3 is a view similar to FIG. 1, but showing the platen in its fully elevated position and pressing the image area portion of the mail piece into firm engagement with the printing surface of the die.

Referring now to the drawings, and particularly to FIGS. 1, 2 and 3 thereof, there is shown in representative form various elements of a mailing machine, generally indicated by the reference numeral 10, the mailing machine 10 having a postage meter, generally indicated by the reference numeral 12, and the postage meter 12 having a printing mechanism, generally indicated by the reference numeral 14. The postage meter 12 is well known in the art and need not be further described herein, other than to point out that the postage meter includes a flat printing die 16 fixedly mounted therein, which has a lower surface 18 on which an image of a postage indicia is formed, so that when the surface 18 of the printing die 16 is inked and an envelope is brought into contact with it, an ink image of the postage indicia is transferred to the envelope.

The mailing machine 10 includes a platform 20, which may be stationary or may be the platform of a mail piece weighing scale which weighs each mail piece just prior to printing postage indicia thereon. A pressure ski assembly, generally indicated by the numeral 22, is suitably mounted over the platform 20 in position to overlie a mail piece 24 which is resting on the platform 20. The pressure ski assembly 22 is typically one of several spaced along the length of the platform 20 for normally maintaining firm frictional driving engagement between the lower surface of the mail piece 24 and the upper surface of a transport belt 26 which moves successive mail pieces to and from the postage meter 12. The ski assembly 22 includes a generally U-shaped frame 28 which is suitably mounted in the mailing machine and has a pin 30 extending therethrough, and a support arm 32 pivotally mounted on the pin 30. A roller 34 is rotatably mounted on the lower end of the support arm 32, and a suitable spring (not shown) urges the support arm in a downward direction so as to press the roller 34 firmly against the upper surface of the mail piece 24 directly over the transport belt 26, thereby ensuring effective driving engagement between the lower surface of the mail piece 24 and the belt 26. The ski assembly 22 also includes a laterally extending projection or wing 36 connected to a side portion of the support plate 32, the wing 36 extending sufficiently far to be in the path of movement of a platen 38 for a purpose to become clear.

The printing mechanism 14 includes the platen 38 which is suitably mounted in the mailing machine 10 for vertical movement caused by rotation of a gear 40 driven by a shaft 42, and which engages with a rack 44 formed as part of the platen 38. It will be apparent that rotation of the gear 40 in opposite directions drives the platen 38 up and down. For further details on the structure and operation of the printing mechanism 14, reference is hereby made to U.S. Pat. No. 5,269,220, issued Dec. 14, 1993, and assigned to the assignee of this application.

The platen 38 supports a pressure pad 46, formed of a suitable foam rubber or similar material, on the upper surface thereof, the purpose of the pressure pad being to ensure uniform contact between the image area portion 24P of the mail piece 24 with the printing surface 18 of the die 16 when the platen 38 is moved to its uppermost position. A metal strip 48 is secured to the upper surface of the pressure pad 46 along the outboard edge thereof to provide a substantially rigid surface portion for engaging the wing 36 of the ski assembly 22 during upward movement of the platen 38.

FIGS. 2 and 3 illustrate the operation of the prior art mechanism and the problem which the improvement of the present invention eliminates. As the platen 38 rises in response to rotation of the gear 40 on the driving shaft 42, the upper surface of the pressure pad 46 makes initial contact with the undersurface of the mail piece 24 in the vicinity of the lower edge of the wing 36. Continued upward movement of the platen 38 causes the mail piece 24 to begin to tilt upwardly until at least the printing portion 24P thereof, if not perhaps most or all of the mail piece 24 depending upon the lateral dimension thereof, is disposed at an angle to the plane of the upper surface of the pressure pad 46 and the lower surface 18 of the printing die 16, these two surfaces being parallel to one another. As the platen 38 rises further, the lower surface of the printing portion 24P of the mail piece 24 is clamped by the wing 36 of the ski assembly 22 against the outboard edge of the pressure pad 46, with the result that a pivot line, indicated by the point P1 in FIG. 2, is established in the mail piece 24 adjacent the outboard edge of the pressure pad 46. As the pressure pad 46 pushes further upwardly on the now angled image area portion 24P, it raises the roller 34, support plate 32 and wing 36 of the ski assembly 22, and raises the image area portion 24P still further. During this further upward movement, the rear edge of the image area portion 24P makes initial contact with the rear edge of the printing surface 18 of the die 16, thereby establishing an initial line of contact between the image area portion 24P and the printing surface 18 along the rear edge of the printing surface 18. This contact is sufficient to transfer an ink image to the image area portion 24P of whatever image lies along the rear edge of the printing surface 18 of the die 16. This is essentially the condition illustrated in FIG. 2.

As the platen continues to move further upwardly from the position show in FIG. 2 toward that shown in FIG. 3, it will be seen that, since the image area portion 24P of the mail piece 24 remains rigidly clamped between the lower edge of the wing 36 and the upper outboard edge of the pressure pad 46, the image area portion 24P is gradually rotated about the pivot line P1 to assume a position in which it is parallel to the printing surface 18 of the die 16. During this movement, the rear edge of the image area portion 24P would normally move in an arcuate path about the pivot point P1 as indicated by the curved line L1 shown in FIG. 2. But since the pivot point P1 is moving upwardly in a straight line, continued upward movement of the image area portion 24P causes it to shift laterally toward the rear edge of the printing surface 18 of the die 16 by an amount represented by the space S between the arrows A. The result is that during the final stages of upward movement of the platen 38 to the position shown in FIG. 3, the entire image area portion 24P is being displaced laterally with respect to the printing surface 18, even as it is being pressed into intimate contact with the printing surface 18. As indicated previously, while this relative movement between the image area portion 24P of the mail piece 24 and the printing surface 18 of the die 16 is of a relatively small magnitude, it is nevertheless sufficient to cause the ink to smear on the mail piece and result in a printed indicia which does not meet the print quality standards of the USPS, thereby rendering the postage meter commercially unacceptable.

It should be kept in mind that all of the foregoing operations take place at a very rapid rate, probably not exceeding 0.250 seconds from the time the platen 38 starts to move upwardly until it returns to its bottommost position. This tends to accentuate the upward tilt of the image area portion 24P of the mail piece and, therefore, the lateral shift between it and the printing surface 18 of the die 16, indicating that the faster the printing operation takes place, the greater will be the degree of smudge or smear of the printed indicia.

Figure 5:
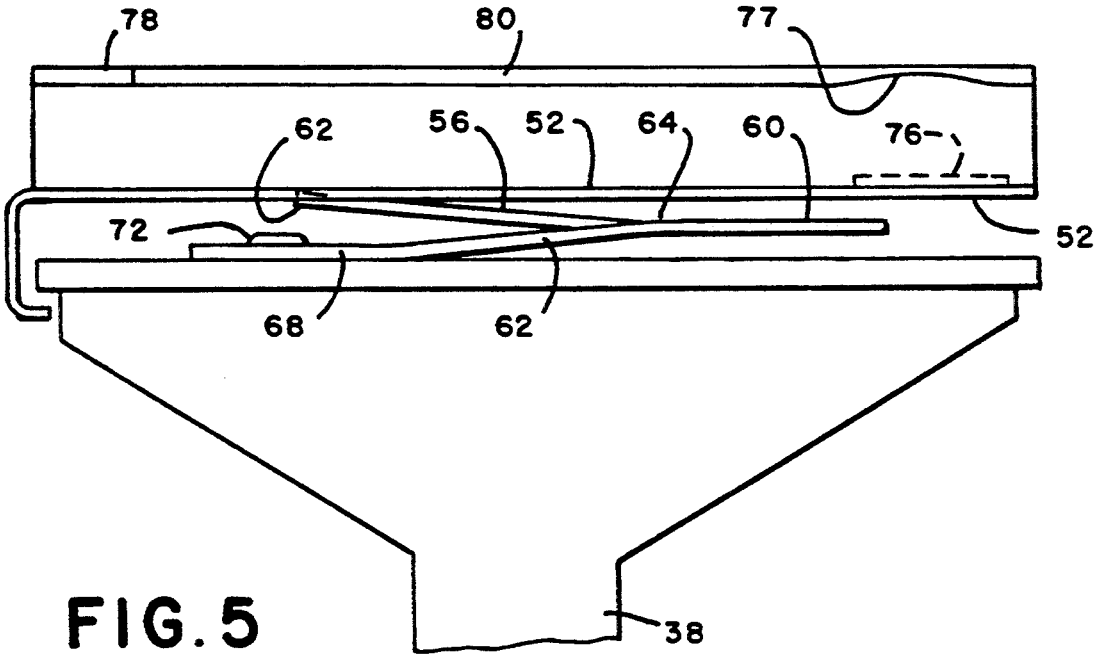
FIG. 5 is a side view, drawn to an enlarged scale, of the upper portion of the platen and the pressure pad with the flexible supporting member therebetween.
Figure 4:
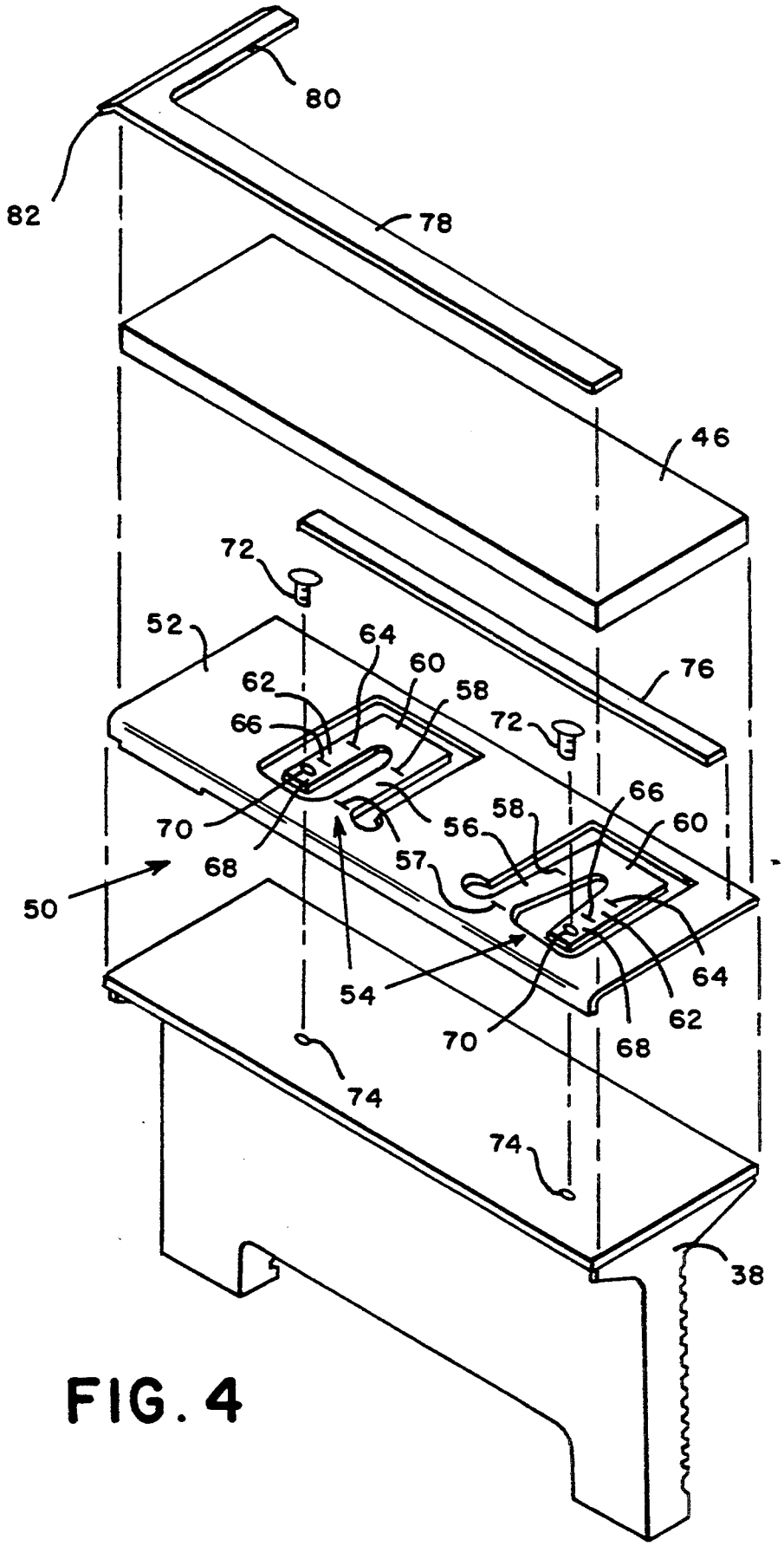
FIG. 4 is a perspective view of the platen and pressure pad shown in FIGS. 1–3, and the flexible supporting member which is interposed between the upper surface of the platen and the lower surface of the pressure pad.

The foregoing problem has been very effectively solved by the present invention in which a flexible support member is interposed between the upper surface of the platen and the lower surface of the pressure pad which allows the pressure pad to move in both linear and angular directions, thereby eliminating the relative movement between the image area portion 24P of the mail piece 24 and the printing surface 18 of the die 16. Thus, as best seen in FIGS. 4 and 5, the flexible support member, generally indicated by the reference numeral 50, comprises essentially a flat, planar body member 52 having substantially the same longitudinal and lateral dimensions as the upper surface of the platen 38. The body member 52 includes a pair of generally U-shaped resilient mounting members, generally indicated by the numeral 54, by which the flexible support member 50 is secured to the upper surface of the platen 38. The mounting members 54 are identical in all respects except that they may be in diametrically opposed relationship on the body member 52. The mounting members 54 are stamped out of the planar body member 52, and each mounting member comprises a first laterally extending arm 56 which is integrally joined to the body member 52 at a first bend line indicated by the dotted line 57, and which slants downwardly from the plane of the body member 52 to a second bend line indicated by the dotted line 58, at which point the arm 56 is integrally joined to a longitudinally extending arm 60. As best seen in FIG. 5, the arm 60 is disposed in a plane which is parallel to that of the body member 52, but spaced therefrom approximately 0.07 inch. A second laterally extending arm 62 is joined to the longitudinally extending arm at a third bend line indicated by the dotted line 64, and slants further downwardly to a fourth bend line indicated by the dotted line 66, at which point the second laterally extending arm 62 merges with a terminal portion 68 which is disposed in a plane which is parallel to that of the body member 52, but is spaced therefrom approximately 0.14 inch. As best seen in FIG. 4, each terminal portion 68 is provided with an aperture 70 through which a screw 72 passes and which is threaded into an aperture 74 in the upper surface of the platen 38, thereby securing the body member 52 to the platen.

The pressure pad 46 is secured to the upper planar surface of the body member 52 merely by bonding with a suitable adhesive agent. An elongate strip 76 of substantially rigid material is interposed between the lower surface of the pressure pad 46 and the upper surface of the body member 52 adjacent the rear edge thereof to provide a slight bulge 77 (see FIG. 5) in the upper surface of the pressure pad 46 along the rear edge thereof. The purpose of the bulge 77 is to provide better support for the extreme rear edge portion of the image area portion of a mail piece having a relatively thick contents except in the area of the extreme rear edge portion.

A bearing strip 78, formed of metal or other substantially rigid material, is suitably secured to the upper front edge portion of the pressure pad 46 to provide a firm bearing surface for the wing 36, so that the wing 36 is not depressed into the resilient material of the pressure pad 46 when it moves upwardly during a printing operation. The bearing strip 78 also has a laterally extending portion 80 with a turned down lip 82 which functions as a guide for the lead edge of a mail piece as it moves over the pressure pad.

Finally, as best seen in FIGS. 4 and 5, the body member 62 includes a downturned flange 84 which extends the length of the body member 52, and an inturned lip 86 which extends along a short portion of the downturned flange 84 which services to limit the extent of upward movement of the pressure pad 46 and also prevents undesirable vibration of the pressure pad 46 during high speed operation of the printing apparatus 14.

Figure 6:
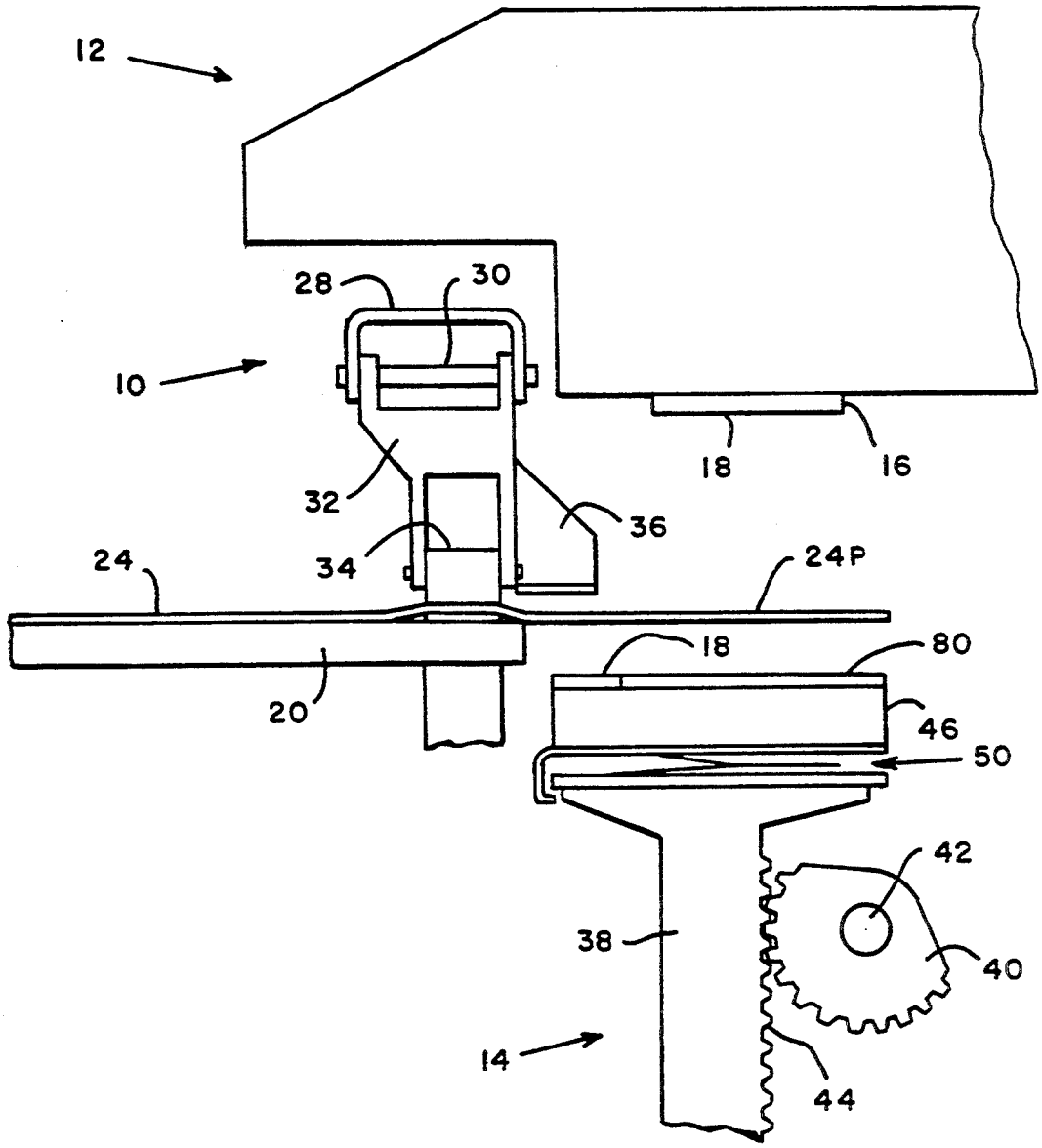
FIG. 6 is a view similar to FIG. 1, but showing the position of the parts with the flexible supporting member of the present invention installed.
Figure 7:
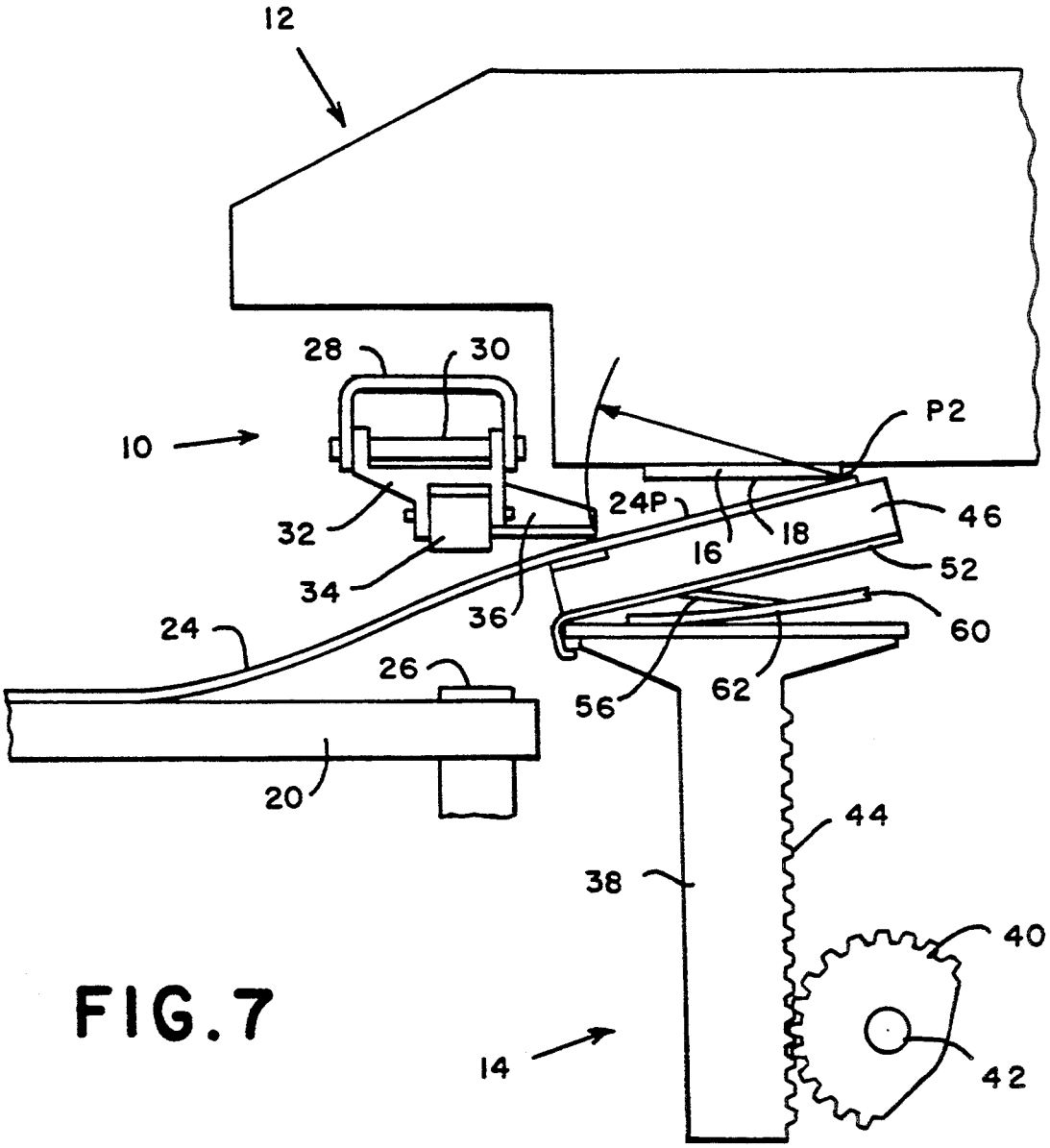
FIG. 7 is a view similar to FIG. 6, but showing the platen in a partially elevated position with the image area portion of a mail piece being pushed toward the printing surface of the die.
Figure 8:
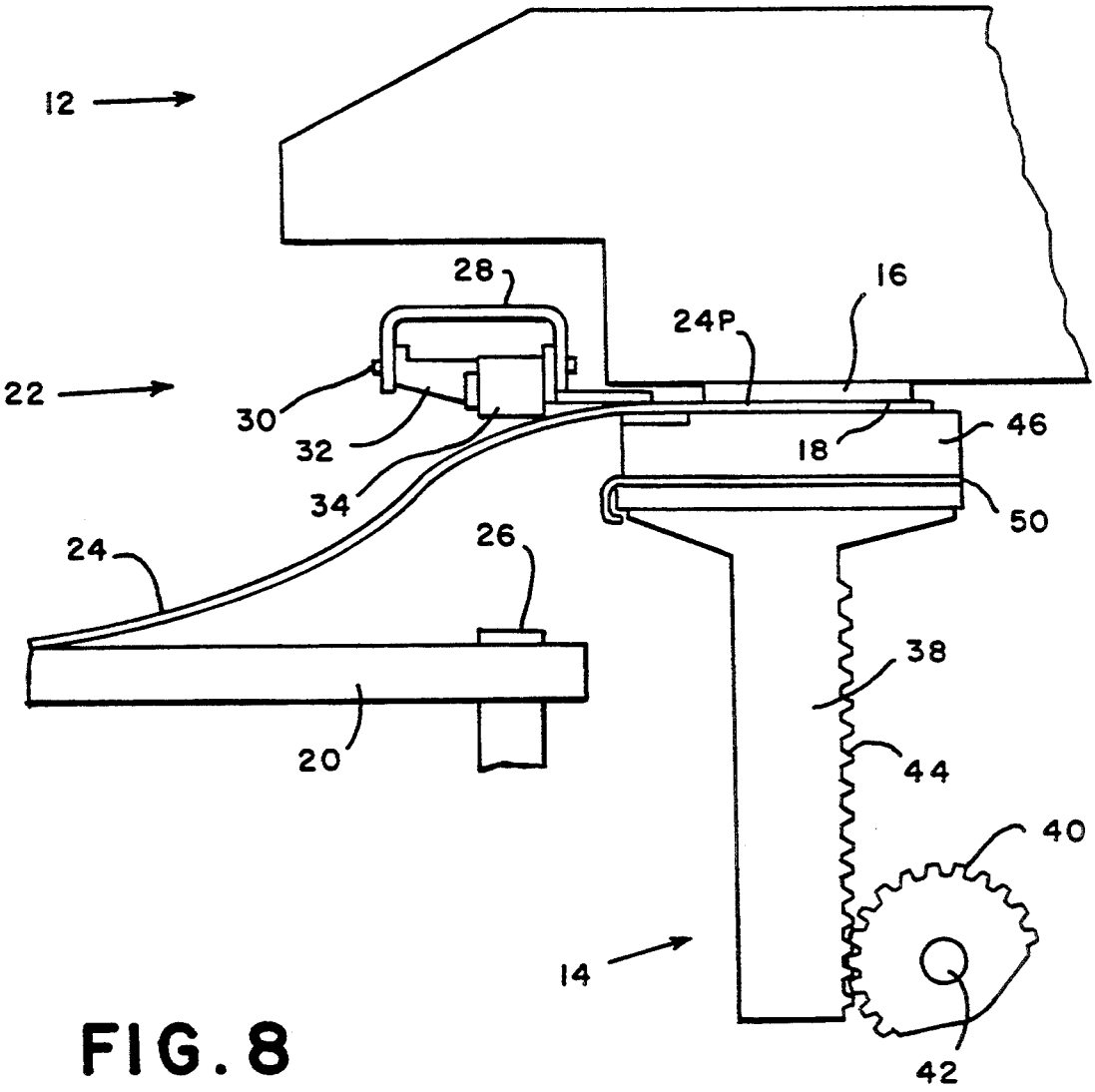
FIG. 8 is a view similar to FIG. 7, but showing the platen in its fully elevated position and pressing the image area portion of the mail piece into firm engagement with the printing surface of the printing die.

With reference now to FIGS. 6, 7 and 8, the operation of the printing apparatus with the present invention installed therein will be explained. FIG. 6, corresponds to FIG. 1 and shows the printing apparatus 14 with the platen 38 and the pressure pad 46 thereon in the lowermost position, and with the flexible support member 50 interposed between the pressure pad 46 and the top of the platen 38. As was explained previously in connection with FIG. 2, as the platen 38 is driven upwardly by rotation of the gear 40, the upper surface of the pressure pad still makes initial contact with the undersurface of the mail piece 24 in the vicinity of the lower edge of the wing 36, and continued upward movement of the platen 38 still causes the mail piece 24 to begin to tilt upwardly until at least the image area portion 24P is disposed at an angle to the plane of the upper surface of the pressure pad 46 and the lower printing surface 18 of the printing die 16. As the platen 38 still continues to rise, the lower surface of the image area portion 24P of the mail piece is again clamped by the wing 36 of the ski assembly against the bearing strip 78 on the outboard edge of the pressure pad, but with the flexible support member 50 of the invention in place, the pivot line P1 described above in connection with FIG. 2 is not created. Rather the entire pressure pad 46 begins to tilt due to the flexure of the support member 50 in the first and second pairs of lateral arms 56 and 62, so that the upper surface of the pressure pad 46 gradually approaches surface to surface contact with the lower surface of the image area portion 24P. As the platen 38 rises still further with the pressure pad 46 tilted as seen in FIG. 7, the rear edge of the image area portion 24P makes initial contact with the rear edge of the printing surface 18, thereby establishing the same line of contact between the image area portion 24P and the printing surface 18, much the same as that which occurs with the device shown in FIG. 2. But since the pressure pad 46 is tilted at the same angle as that of the image area portion 24P, the line of contact at the rear edge of the printing surface 18 now becomes a pivot point, labeled P2. This is essentially the condition shown in FIG. 7.

As the platen 38 continues to move further upwardly from the position shown in FIG. 7 toward that shown in FIG. 8, it will be seen that the image area portion 24P and the pressure pad 46 will tilt in unison in the opposite direction about the pivot point P2 so that the image area portion 24P is gradually brought into intimate surface to surface contact with the printing surface 18 of the die 16. Since this movement occurs about the pivot point P2, there is no lateral displacement of the image area portion 24P relative to the printing surface 18, thereby resulting in a sharp and clear ink image of the postage indicia being transferred from the printing die 16 to the image area portion 24P. And this will occur despite the extremely rapid rate at which the printing operation take place due to the combined factors of the linear movement of the pressure pad 46 absorbing some of the shock of the sudden impact of the pressure pad on the image area portion 24P of the mail piece, and the angular movement of the pressure pad 46 allowing it to conform to the tilt angle of the image area portion 24P and thereby eliminating the pivot line P1. It has been seen in the development of the present invention that the difference between the print quality of postage indicia printing without and then with the present invention is quite pronounced, despite the relatively small difference in the characteristic of movement by which the image area portion 24P of the mail piece 24 and the printing surface 18 of the printing die 16 are brought together.

Figure 9:
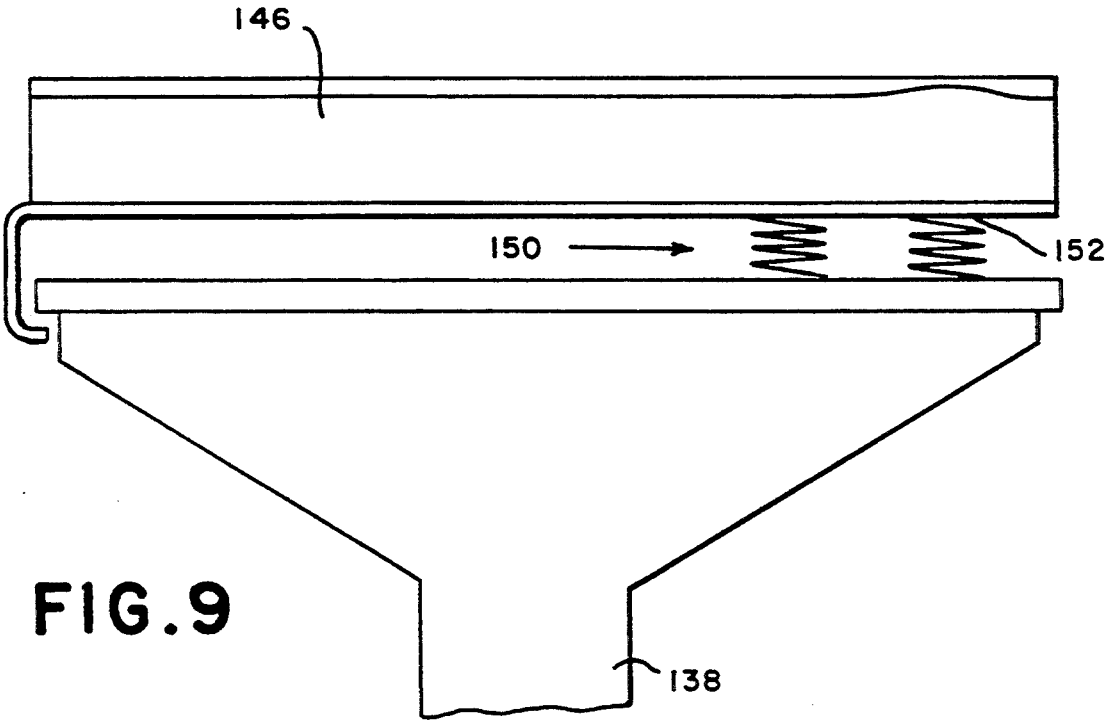
FIG. 9 is a view similar to FIG. 5 but showing another embodiment of the flexible supporting member of the invention.

FIG. 9 shows an alternative embodiment of the invention in which the flexible support member 50 is replaced by a plurality of compression springs 150 which are suitably secured to the upper surface of the platen 138 and to the lower surface of a suitable support plate 152 to which the resilient pressure pad 146 is suitably secured. The arrangement and number of the compression springs 150 is flexible depending on the desired extent and direction of vertical and angular movement of the pressure pad as well as the degree of resistance to such movement. Thus, there can be one or more longitudinally extending, laterally spaced rows or springs, with each row having a variable number of longitudinally spaced springs.

Figure 10:
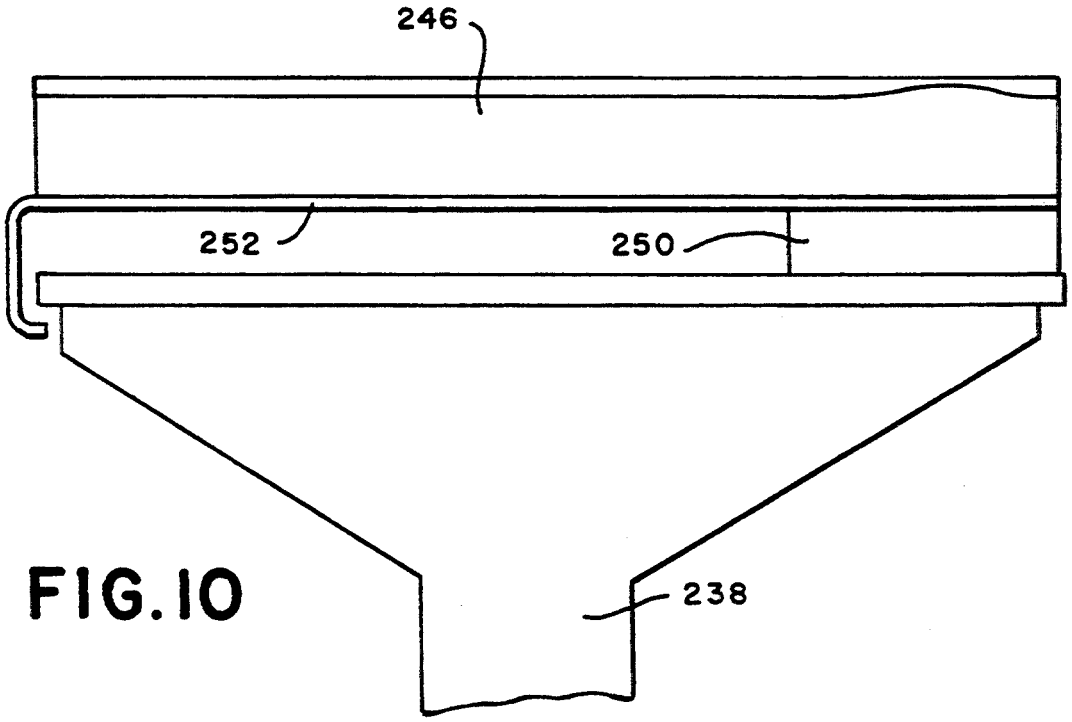
FIG. 10 is a view similar to FIG. 5 but showing still another embodiment of the flexible supporting member of the invention.

FIG. 10 shows still another embodiment of the invention in which the flexible support member 50 is replaced by a block of foam material 250 suitably bonded to the upper surface of the platen 238 and the lower surface of a suitable support plate 252 to which the pressure pad 246 is suitable secured. Again, the size of the block of foam material and its location on the platen 238, as well as the density of the foam, are all variables which may be selected to provide the desired characteristic of vertical and angular movement of the pressure pad 246.

It will, or course, be apparent that the operation of the embodiments of the invention shown in FIGS. 9 an 10 is identical to that described above for the embodiment shown in FIGS. 4 to 8.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

I claim:

1. A flat bed postage indicia printing mechanism for a postage meter, said printing mechanism comprising:

A. a flat printing die fixedly mounted in the printing mechanism,

B. a platen mounted beneath said printing die and having an upper surface normally disposed in spaced parallel relationship with the printing surface of said printing die, C. a pressure pad positioned on said upper surface of said platen for contacting the lower surface of a mail piece, D. means for moving said platen toward and away from said printing die so as to bring a printing portion of the upper surface of a mail piece resting on said platen into contact with said printing surface of said printing die, and E. means disposed between said upper surface of said platen and said pressure pad for supporting said pressure pad on said platen for limited linear and angular movement with respect to said upper surface of said platen, whereby as said platen moves upwardly, said pressure pad moves linearly with respect to said upper surface of said platen to absorb the shock of high speed impact with said image area portion of the mail piece and angularly with respect to said upper surface of said platen so that the plane of the upper surface of said pressure pad conforms to the plane of said image area portion as said platen pushes said image area portion upwardly toward said printing die.

2. A flat bed printing mechanism as set forth in claim 1 wherein said pressure pad supporting means comprises flexible means normally supporting said pressure pad on said supper surface of said platen with the lower surface of said pressure pad disposed in spaced relationship with said upper surface of said platen.

3. A flat bed printing mechanism as set forth in claim 2 wherein said flexible means comprises a. a generally flat supporting means for holding said pressure pad on the upper surface thereof, and b. means for securing said supporting member to the upper surface of said platen.

4. A flat bed printing mechanism as set forth in claim 3 wherein

A. said supporting means comprises a substantially flat body member having a planar configuration substantially corresponding to the planar configuration of said upper surface of said platen, said pressure pad being secured to the upper surface of said body member, and B. said means for securing said body member to the upper surface of said platen comprises a plurality of generally U-shaped resilient mounting members each connected at one end to said body member and having a terminal portion at the other end which is disposed in a plane lying in spaced parallel relationship to the plane of said body member and is secured to said upper surface of said platen.

5. A flat bed printing mechanism as set forth in claim 4 wherein said mounting members each comprises A. a first arm extending laterally of said body member and integrally connected thereto at an angle which slants downwardly toward said upper surface of said platen, B. a longitudinally extending arm connected to said first laterally extending arm and lying in a plane parallel to the plane of said body member, and C. a second laterally extending arm connected to said longitudinally extending arm at an angle which slants downwardly toward said upper surface of said platen, said second laterally extending arm being connected to said terminal portion, whereby said body member and said pressure pad secured thereto can move both linearly and angularly with respect to said upper surface of said platen.

6. A flat bed printing mechanism as set forth in claim 3 wherein

A. said supporting member comprises a substantially flat body member having a planar configuration substantially corresponding to the planar configuration of said upper surface of said platen, said pressure pad being secured to the upper surface of said body member, and B. said means for securing said body member to the upper surface of said platen comprises at least one compression spring interposed between the lower surface of said body member and said upper surface of said platen and secured thereto.

7. A flat bed printing mechanism as set forth in claim 3 wherein

A. said supporting member comprises a substantially flat body member having a planar configuration substantially corresponding to the planar configuration of said upper surface of said platen, said pressure pad being secured to the upper surface of said body member, and B. said means for securing said body member to the upper surface of said platen comprises a block of foam material interposed between the lower surface of said body member and said upper surface of said platen and secured thereto.

8. A flat bed postage indicia printing mechanism for a postage meter, said printing mechanism comprising:

A. a flat printing die fixedly mounted in the printing mechanism,

B. a platen mounted beneath said printing die and having an upper surface normally disposed in spaced parallel relationship with the printing surface of said printing die, C. a pressure pad positioned on said upper surface of said platen for contacting the lower surface of a mail piece, D. means for moving said platen toward and away from said printing die so as to bring a printing portion of the upper surface of a mail piece resting on said platen into contact with said printing surface of said printing die, and E. means disposed between said upper surface of said platen and said pressure pad for supporting said pressure pad on said platen for limited linear and angular movement with respect to said upper surface of said platen and for preventing linear shifting of said mail piece during printing when said platen forces said mail piece into contact with said printing surface of said printing die.

9. A flat bed printing mechanism as set forth in claim 8 further comprising a ski assembly which operatively associated with said pressure pad to engage said mail piece between said ski assembly and said pressure pad during upward movement of said platen and printing of said mail piece.

* * * * *